US007927267B2

(12) United States Patent
Splane

(10) Patent No.: US 7,927,267 B2
(45) Date of Patent: Apr. 19, 2011

(54) ABDOMINAL EXERCISE DEVICE

(76) Inventor: Robson Splane, Valley Center, CA (US)

( * ) Notice: Subject to any disclaimer, the term of this patent is extended or adjusted under 35 U.S.C. 154(b) by 60 days.

(21) Appl. No.: 12/545,627

(22) Filed: Aug. 21, 2009

(65) Prior Publication Data

US 2010/0062914 A1 Mar. 11, 2010

Related U.S. Application Data

(63) Continuation-in-part of application No. 12/230,898, filed on Sep. 8, 2008.

(51) Int. Cl.
*A63B 21/00* (2006.01)

(52) U.S. Cl. ..... 482/142; 482/130; 482/146

(58) Field of Classification Search ..... 482/142, 482/130, 140, 148, 135, 146, 147; 606/243, 606/242

See application file for complete search history.

(56) References Cited

U.S. PATENT DOCUMENTS

| | | | | |
|---|---|---|---|---|
| 4,669,723 | A | 6/1987 | Arsenian | |
| 4,799,475 | A | 1/1989 | Iams et al. | |
| 4,846,465 | A | 7/1989 | Iams et al. | |
| 4,858,918 | A | 8/1989 | Iams et al. | |
| 4,886,050 | A | 12/1989 | Iams et al. | |
| 4,989,860 | A | 2/1991 | Iams et al. | |
| 5,141,483 | A * | 8/1992 | Smith | 482/142 |
| 5,306,223 | A | 4/1994 | Martinez | |
| 5,607,374 | A | 3/1997 | Hesse | |
| 6,440,045 | B1 | 8/2002 | Gaston | |
| 6,485,398 | B1 | 11/2002 | Kreft | |
| 6,626,807 | B1 | 9/2003 | Richmond | |
| 7,156,786 | B1 | 1/2007 | Palmer | |
| 2007/0149370 | A1 | 6/2007 | Brown et al. | |

FOREIGN PATENT DOCUMENTS

| | | | |
|---|---|---|---|
| EP | 1 810 718 | A2 | 7/2007 |
| WO | WO 2008/122143 | A1 | 10/2008 |

* cited by examiner

*Primary Examiner* — Jerome Donnelly

(74) *Attorney, Agent, or Firm* — Sam Tahmassebi; TechLaw LLP

(57) ABSTRACT

An exercise device is disclosed having at least a base, first and second knee supports which are bilaterally coupled to first and second pivots located off from the center of the base. Independently rotatable knee pads are coupled to the perimeter-side end of the first and second knee supports arranged around a perimeter of the base. An upper extremity support is coupled to the base, and a first base supporting member is positioned at a rear of the base and a second base supporting member is positioned at a front of the base, wherein at least one of an inclination and elevation of the base is determined by adjustment of the base supporting members, wherein the first and second knee supports move around different arcs to generate an elliptical motion for an individual.

21 Claims, 8 Drawing Sheets

ABDOMINAL EXERCISE DEVICE

CROSS-REFERENCE TO RELATED APPLICATION(S)

This application is a Continuation-In-Part Application claiming benefit of U.S. patent application Ser. No. 12/230,898 filed Sep. 8, 2008, titled "Abdominal Exercise Device", the contents of which are hereby incorporated by reference in its entirety.

TECHNICAL FIELD

This invention relates to exercise equipment. More particularly, this invention relates to a compact device well-suited for exercising the abdominal areas.

BACKGROUND

Health is always on the forefront of many minds. Unfortunately, in this high technology, society dictates how well we maintain our health. Although it is commonly known that diet and exercise are key aspects of maintaining good health, time and money often times supersede our desire to maintain a proper health regimen.

Poor diet and inadequate exercise lead to an uncomfortable lifestyle. Many people are plagued by back pains, in particular, lower back pain. Back pains can be the source of many other discomforts causing problems in walking, sitting, and sleeping. Often times the back pain is due to poor posture, lack of exercise, and lack of stretching causing the back to become stiff and inducing uncomfortable or painful spasms. Stiffness and spasms contribute to the restricted movement of an individual suffering from back pain.

Current exercise devices require lifting of heavy weights while standing or sitting, thereby applying an axial load on the spine and exacerbating bad backs. This can be an additional source of pain. A few devices allow the user to perform middle to lower body exercises in a kneeling position to minimize the axial load; however, these devices are limited in the targeted muscles groups that can be exercised and in the intensity of the exercise. Other exercise devices allow users to conduct exercises in an inclined position; however, these devices are cumbersome, require numerous components, including pulleys and cables, and take up a lot of space. Thus, these devices are inadequate and inefficient.

Therefore, there is still a need for a compact exercise device with minimal components that can allow a user to perform a multitude of exercises while minimizing the axial load on the spine and while being able to increase the intensity of the exercise.

SUMMARY

In general, the present disclosure is directed towards providing an exercise device that is compact and easy to use, that requires minimal parts, and that can target a variety of muscle groups. In addition, the present disclosure provides an exercise device designed at minimizing an axial load on the spine while capable of targeting a plurality of muscle groups. In particular, abdominal muscles are known to be well-targeted. Furthermore, the present disclosure provides an exercise device in which the intensity of the exercise may be adjusted.

Various aspects of the exercise device are described, wherein in one embodiment, an exercise device is provided, comprising: a base; first and second knee supports, coupled to first and second pivots located off from a center of the base; independently rotatable knee pads coupled to a perimeter-side end of the first and second knee supports; an upper extremity support coupled to the base; and a first base supporting member being positioned at a rear of the base and a second base supporting member being positioned at a front of the base, wherein at least one of an inclination and elevation of the base is determined by adjustment of the base supporting members, wherein the first and second knee supports move along different arcs around at least one of a perimeter of the base and a contact ring.

In another aspect of the device, an exercise device is provided, comprising: a main supporting means for supporting an individual in a kneeling position; first and second supporting means for controlling motion of knees of the individual, coupled to first and second pivots located off from a center of the main supporting means; cushioning means for cushioning knees of the individual, coupled to the first and second supporting means, the cushioning means being independently rotatable; a third supporting means for supporting an upper extremity of the individual, coupled to the main supporting means; and a fourth supporting means for supporting the main supporting means, wherein at least one of an inclination and elevation of the main supporting means is determined by adjustment of a length of the fourth supporting means, wherein the first and second supporting means move along different arcs around at least one of a perimeter of the main supporting means and the contact means to generate an elliptical motion for the individual.

In another aspect of the device, a method for operating an exercise machine is provided, comprising: adjusting a height of supporting legs for the exercise machine, wherein at least one of an inclination and elevation of the exercise machine is determined by the adjustment; placing knees on independently rotatable knee pads attached to first and second supports configured to control a motion of the knees, the first and second supports being coupled via first and second pivot points located off center from a center of a base; placing hands on an upper extremity support coupled to the base; and moving the knee pads along different arcs around at least one of a perimeter of the base and a contact ring.

Other aspects are found throughout the specification.

DETAILED DESCRIPTION OF THE DRAWINGS

The detailed description set forth below in connection with the appended drawings is intended as a description of enabling embodiments and is not intended to represent the only forms or embodiments in which may be constructed or utilized. The description sets forth the functions and the sequence of steps for constructing and operating an exemplary embodiment in connection with the illustrated embodiments. It is to be understood, however, that the same or equivalent functions and sequences may be accomplished by different embodiments that are also intended to be encompassed within the spirit and scope of this disclosure.

Various embodiments are directed towards an abdominal exercise device 100 that is simple and compact but can target a variety of muscle groups. This exercise device 100 does not require pulleys, cables, resistance bands, weights and other extraneous accessories required by other exercise equipment, although it can be designed in such ways for advanced exercisers. Rather it only requires the weight of the user and the force of gravity. Also, variable resistance in an exercise can be achieved by adjusting the incline, using gravity as its form of resistance. In addition, the exercise device 100 can fold compactly so as to fit in the closet or under a bed.

Figure 1:
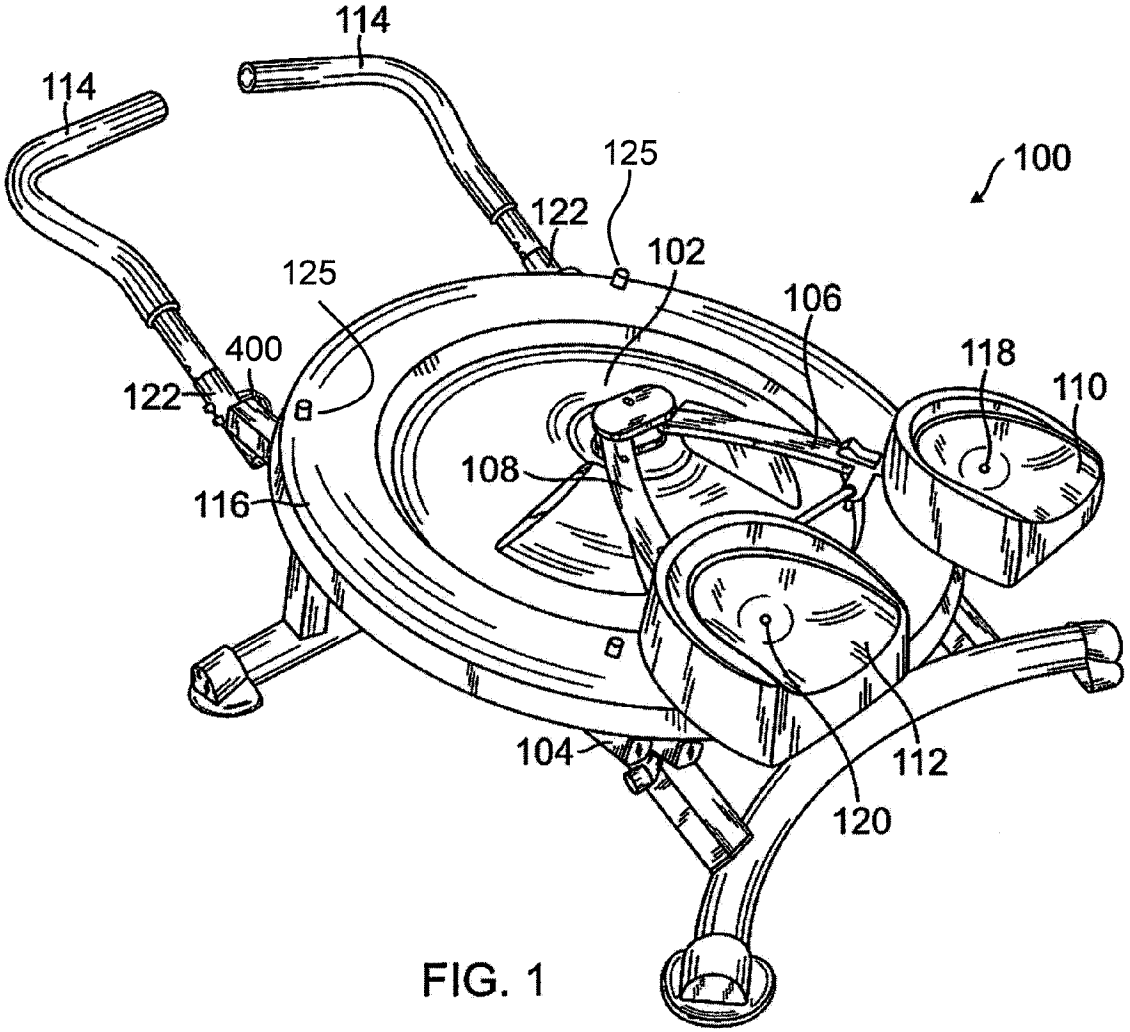
FIG. 1 is a perspective view of an exemplary embodiment.
Figure 2:
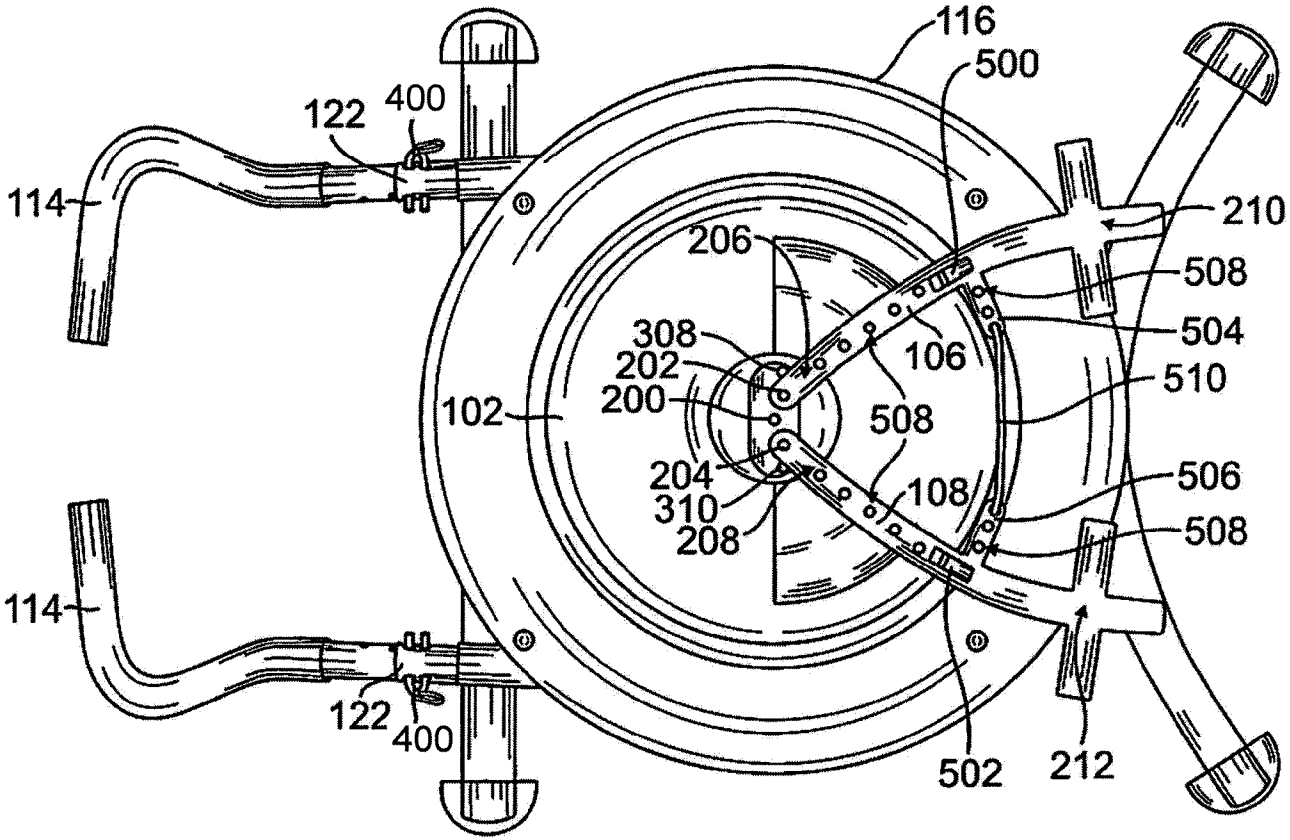
FIG. 2 is a top view of an exemplary embodiment with the knee pads removed.

Referring now to FIGS. 1-2, the exercise device 100 comprises a base 102, a base frame 104 to support the base 102, and a pair of knee pads 110, 112. A user places his knees on the knee pads 110, 112 and supports and stabilizes his upper body grasping the base 102, the base frame 104, or handles 114. A typical (non-limiting) body position for use of this device 100 would be with the knees perpendicular to the thighs, and the thighs perpendicular to the upper body. This position is known to open up the facet joints in the back. Using a variety of muscle groups, such as the abdominals, in particular the transverse abdominous and obliques as well as the lower back muscles, the user pivots his lower body from side to side through a path along the perimeter 116 of the base 102. As further described below, the path for different parts of the body may be an arcuate path or an elliptical path, or variations thereof.

The base 102 provides the structural support for the user to perform the exercises. The base 102 has a perimeter 116 and a center 200 and a means for allowing the knee pads 110, 112 to move along the perimeter 116 in a path. Various means have been contemplated for allowing the knee pads 110, 112 to move along the base 102 in the path. In some embodiments, the perimeter 116 of the base 102 may have a channel or a groove or track. For example, the knee pads 110, 112 may slide along the channel or the groove or track, on bearings, casters, or some other slidable or substantially frictionless surface. Alternatively, the perimeter 116 may have a rail on which the knee pads 110, 112 may ride along. In another embodiment, the perimeter 116 may simply be a flat surface and the knee pads 110, 112 stabilized by support bars 106, 108 may slide, glide, or roll along the flat surface. In embodiments utilizing support bars 106, 108, the base further comprises first and second pivot points 202, 204 located off-center (or bilateral) relative to the center 200. In an off-center embodiment, the knee pads 110, 112 will inherently move along different arcs having a smaller radius than the radius of the base 102. This will result in an elliptical-like motion of the knee pads 110, 112, about the perimeter of the base 102.

In the illustrated FIGS., the base 102 is circular. The base 102, however, may be any geometric shape such as a square, rectangle, triangle, pie shaped, or the like so long as the base 102 has a large enough surface area for the knee pads 110, 112 to move along a controlled path. The base 102 may be made out of any sturdy material providing a smooth surface such as plastic, fiberglass, metal, or the like.

Figure 3:
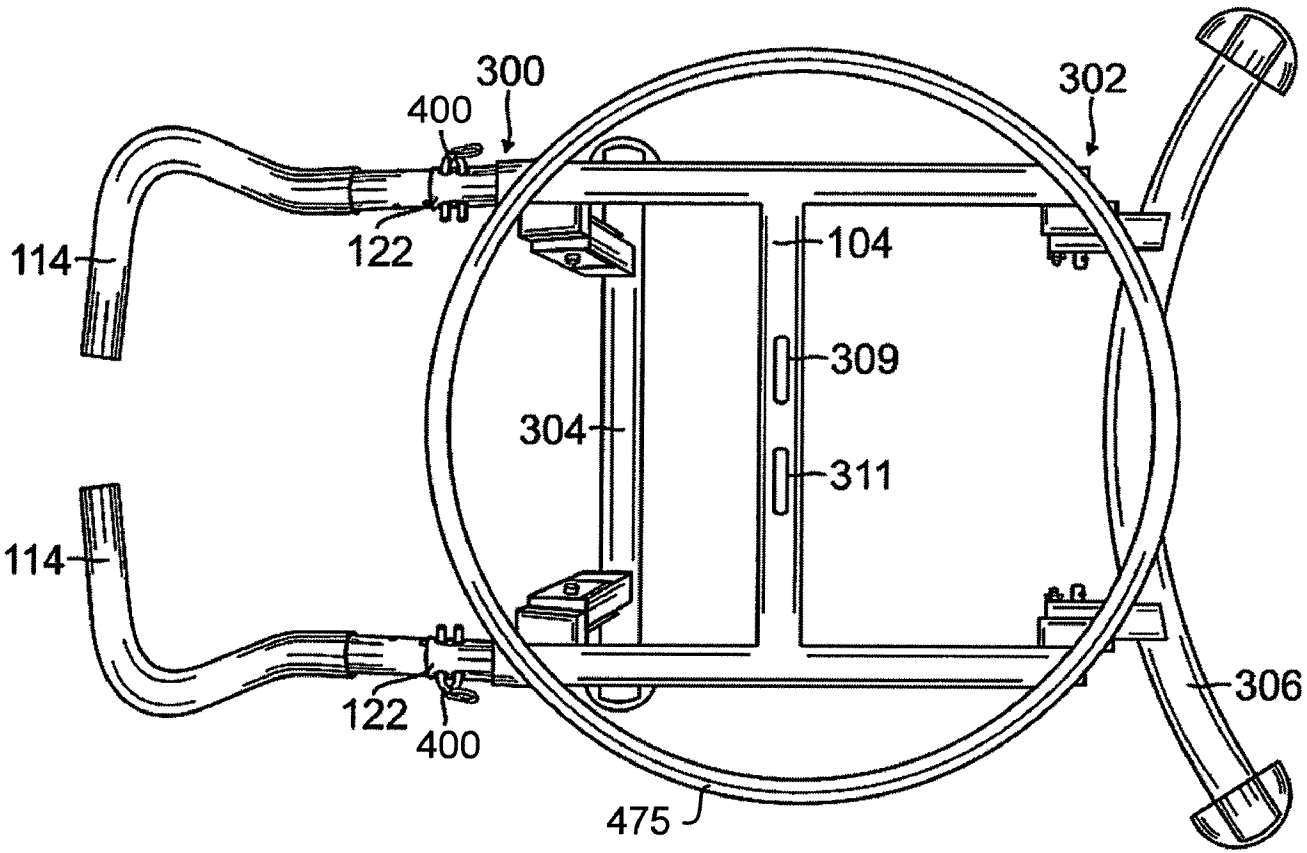
FIG. 3 is a top view of an exemplary embodiment with the base removed showing the frame, legs, and handles.
Figure 4:
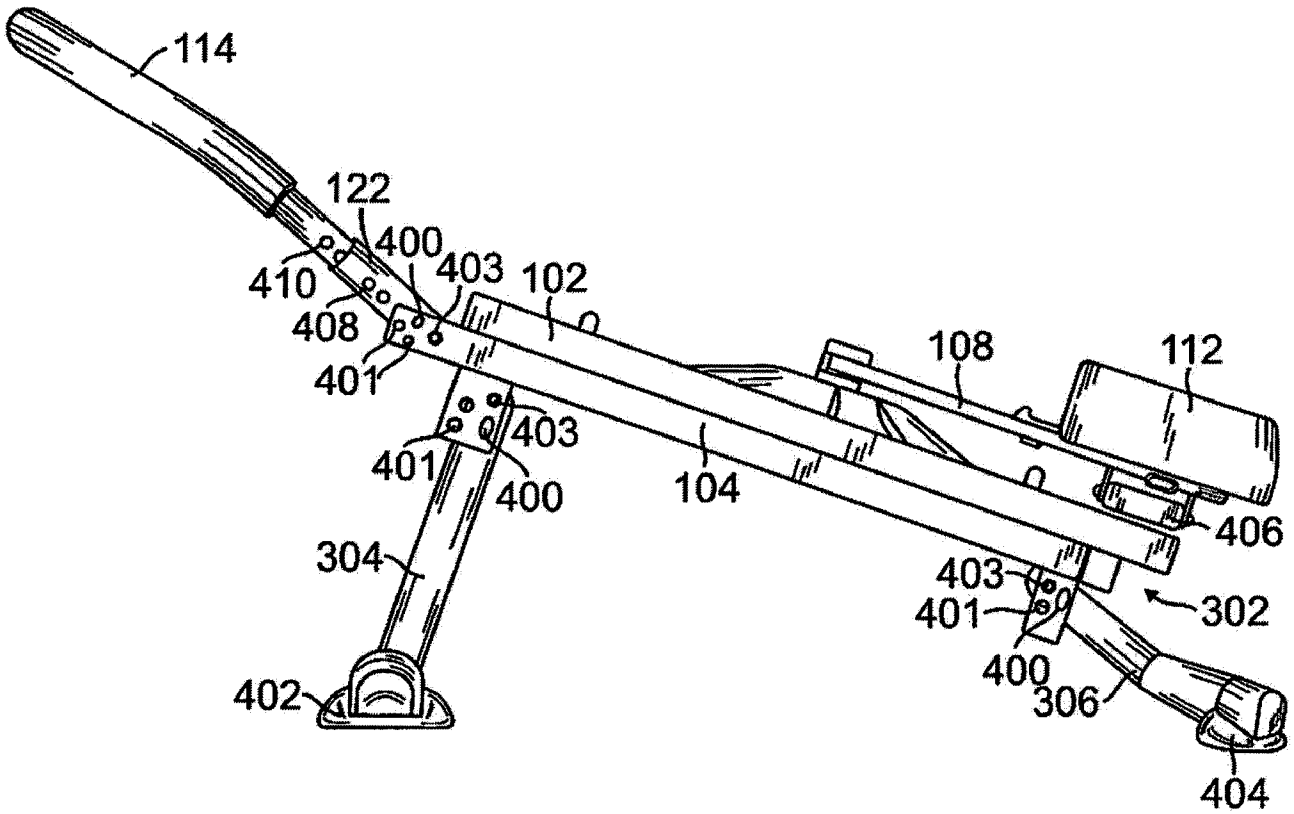
FIG. 4 is a side view of an exemplary embodiment.

As shown in FIG. 3, the base frame 104 provides the structural support for the base 102. The base frame 104 comprises a front portion 300; a rear portion 302 opposite the front portion 300; a front support 304 attached to the front portion 300; and a rear support 306 attached to the rear portion 302. In some embodiments, the front support 304 is longer than the rear support 306, thereby elevating the front portion 300 above the rear portion 302 and providing an incline for the base 102 as shown in FIG. 4. The support or contact ring 475 may be used to support the base 102, or in another embodiment (FIGS. 7-9), the support or contact ring 475 may be exposed as a rideable ring that the user may "ride" on.

In some embodiments, the front support 304 and the rear support 306 are adjustable so as to change the level of incline of the base 102. Thus, the front portion 300 may be higher than the rear portion 302 to create an incline. Alternatively, the rear portion 302 may be higher than the front portion 300 to create a decline. In addition, the front portion 300 and the rear portion 302 may be the same height to create a level surface. Many different ways of adjusting the front and rear support 304, 306 have been contemplated to change the level of incline of the base 102. By adjusting the height of the front and/or rear portions 300, 302, the exercise device can easily enable a user to avoid having his or her feet drag on the floor surface when performing an exercise.

For example, as shown in FIG. 4, front and rear supports 304, 306 with fixed lengths may be pivotably connected to the front portion 300 and rear portion 302, respectively, of the base frame 104, such that the front and rear supports 304, 306 are pivotable in a forward and rearward direction relative to the base frame 104. A standard locking pin 400 may be used to secure the front and rear supports 304, 306 in various positions by inserting the pin 400 into corresponding holes 401 in the frame 104 and the leg supports 304, 306. Since the lengths of the front and rear supports 304, 306 are fixed, placing the front and rear supports 304, 306 directly below the frame 104 at approximately 90° angles to the frame 104 would provide the base 102 with the greatest height or greatest distance from the ground. Having the front support 304 longer than the rear support 306 would thereby create an incline for the base 102 when the front and rear supports 304, 306 are directly underneath and approximately perpendicular to the frame 104. Pivoting the front support 304 away from the rear support 306 would effectively lower the height of the front portion 300 of the base frame 104, thereby decreasing the level of incline. Similarly, pivoting the rear support 306 away from the front support 304 would lower the height of the rear portion 302, thereby increasing the level of the incline of the base 102.

Alternatively, the front and rear supports 304, 306 may utilize a standard telescoping mechanism to effectively change the incline of the base 102. In some embodiments, the front and rear supports 304, 306 may be pivotably connected to the frame 104 and also be telescoping. Pivotably connecting the front and rear supports 304, 306 to the frame 104 also provides a mechanism for compactly folding the exercise device 100 for storage or travel.

Figure 5:
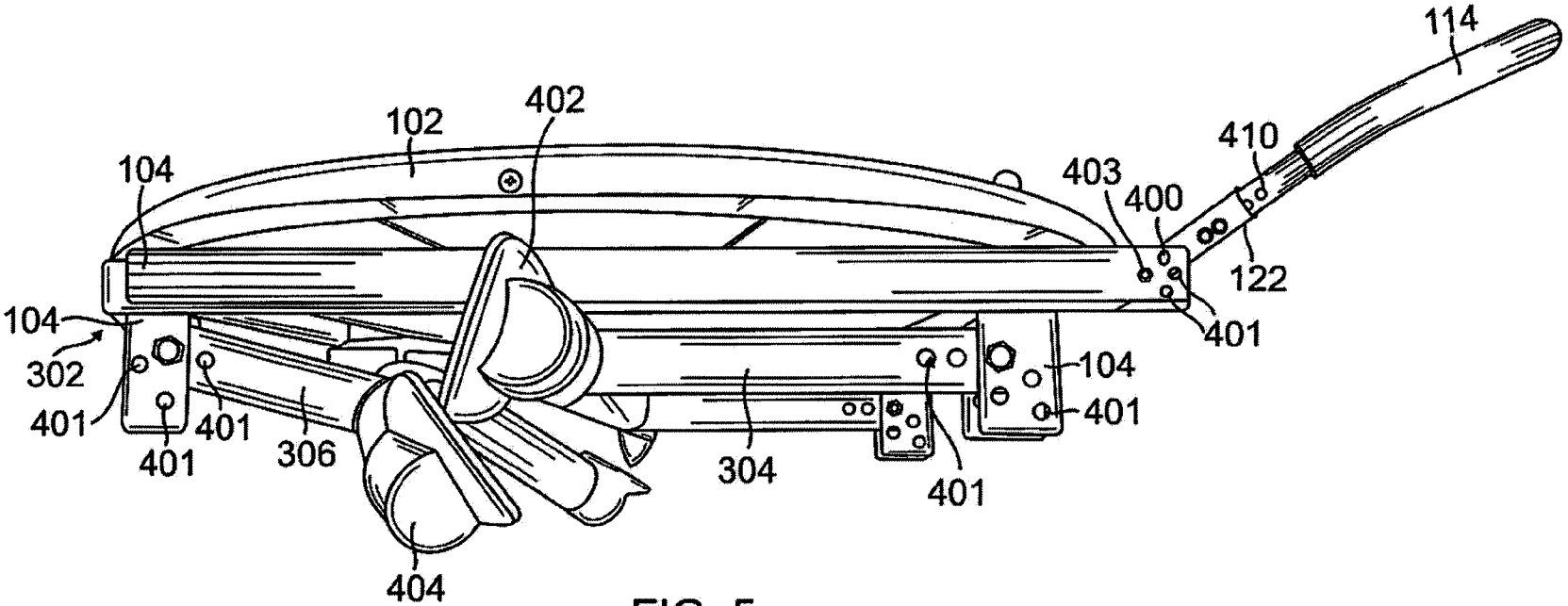
FIG. 5 is a view of an exemplary embodiment in a storage configuration.

As shown in FIG. 5, the front and rear supports 304, 306 may be pivoted towards each other and folded underneath the base 102 and base frame 104 until the front and rear supports 304, 306 are substantially parallel to the base 102 and base frame 104. Gripping and/or cushioning feet 402, 404 may be placed at the ends of the front and rear supports 304, 306.

In embodiments in which the support bars 106, 108 provide the mechanism for allowing the knee pads 110, 112 to rotate along a curved or circular path. The first and second support bars 106, 108 each have a mounting end 206, 208 and a support end 210, 212. The mounting ends 206, 208 are pivotably secured to their respective pivot points 202, 204, which are off-center (or bilateral) to the center 200 of the base 102. This fixes one end of the support bars 106, 108 in place while allowing the support ends 210, 212 to move through the desired path.

In some embodiments, the mounting ends 206, 208 may share the same pivot point, for example, at the center 200 of the base. In other embodiments, the mounting ends 206, 208 may be adjustable, as shown in FIG. 2. For example, rather than a single set of bilateral (or off center) pivot holes 308, 310, the base 102 and base frame 104 may comprise a plurality of bilateral pivot holes 308, 310. This has significant improvements over prior art devices in that the user can select on which pivot hole 308, 310 to mount the leg supports 106, 108, thereby effectively modifying the path of motion for the user's body mass along which the knee pads 110, 112 may traverse, to provide a non-arcuate motion, such as a reduced arc, elliptical or extended circle. By utilizing various pivot points, the user is able to "fine tune" his exercise by targeting specific muscle groups or establish more comfortable positions.

In another embodiment, the base 102 and base frame 104 may comprise bilateral (or off center) slots 309, 311 rather than holes 308, 310 to allow the mounting ends 206, 208 to slide to different positions. In embodiments in which the mounting ends 206, 208 of the support bars 106, 108 are laterally adjustable, the base 102 and base frame 104 are sufficiently large enough to accommodate the widest settings. In other words, with the support bars 106, 108 mounted on the lateral most position, the knee pads 110, 112 can still ride along the perimeter 116 of the base 102.

Each support bar 106, 108 may have a knee pad 110, 112 attached to the top side of the support end 210, 212 and a movement mechanism 406 (only 1 shown) below the knee pad 110, 112 in between the support bar 106, 108 and the base 102 as shown in FIG. 4. Thus, the first support bar mounting end 206 is pivotably attached to the first pivot point 202 and the second support bar mounting end 208 is pivotably attached to the second pivot point 204 and the first and the second support ends 210, 212 are movably mounted on the perimeter 116 of the base 102 such that the first and the second support ends 210, 212 are movable.

The movement mechanisms 406 provide support to the knee pads 110, 112 while allowing the knee pads 110, 112 to slide, glide, roll, or otherwise move along the base 102. For example, the movement mechanism 406 may be a wheel, a roller, a bearing system, such as a ball bearing or roller bearing, a substantially frictionless pad, and so forth. Thus, the lower body weight of the user can be supported by the base 102, rather than on the support bars 106, 108. Accordingly, the support bars 106, 108 do not necessarily have to be constructed of heavy weight bearing material.

The knee pads 110, 112 provide a comfortable support system for directly supporting the knees during an exercise and enable the weight of the user to be born on the tibia rather than the patella. The knee pads 110, 112 may be made from any sturdy material that provides some cushioning and comfort to the knees, such as rubber, foam, or the like, during an exercise. The knee pads 110, 112 move along the perimeter 116 of the base 102 in an appropriate path about their respective pivot points 202, 204 located near the center 200 of the base 102. In addition, the knee pads 110, 112 may be pivotable about their own rotation points 118, 120. Having pivotable knee pads 110, 112 may reduce torque or strain on the knees and legs as the lower body pivots around the perimeter 116 of the base 102.

It is understood that in some embodiments, the placement of the first and second pivot points 202, 204, being non-co-located, for the support bars 106, 108 enable the motion of the body of the user to traverse an elliptical path or semi-elliptical path. That is, twin centers of motion can be achieved by the two pivot points 202, 204. The degree of ellipticity of motion of the user's body mass, trunk, or lower body can be controlled by mating the mounting ends 206, 208 at different pivot holes 308, 310 with the holes 508 in the support bars 106, 108. In some embodiments, the user may elect to vary the degree of ellipticity, as desired, by appropriate adjustment of the pivot points 202, 204. As should be apparent, by combining the elliptically-capable motion with the rotational aspects of the pivotable knee pads 110, 112, a more concentrated motion or more effective exercise motion can be realized. It should also be understood that by using two centers of motion in a particular orientation, the range of motion of the user can be limited—providing over rotation—thus providing a "built-in" safety mechanism. In some embodiments, restriction members or protrusions 125 may be positioned at an upper section of the base 102 according to design preference.

In addition, the first and the second support bars 106, 108 each may comprise a lock 500, 502 to prevent the swiveling or rotating action of the knee pads 110, 112 about their own rotation points 118, 120. The knee pads 110, 112 may have engagement slots 600 into which the locks 500, 502 may slide to prevent pivoting or rotation of the knee pads 110, 112.

Figure 6:
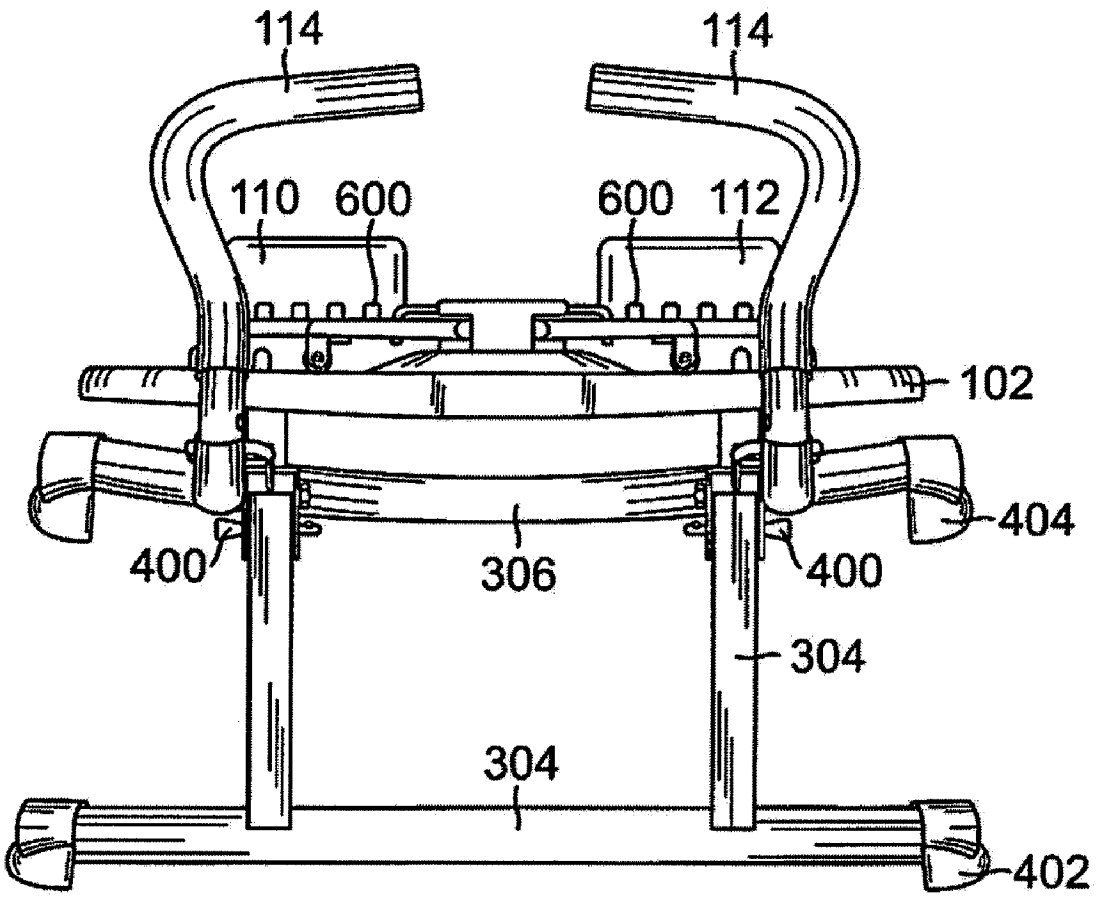
FIG. 6 is a front view of an exemplary embodiment.

As shown in FIG. 6, the knee pads 110, 112 may have a plurality of engagement slots 600 located in various positions along the knee pads 110, 112 so that the knee pads 110, 112 may be locked at various angles or positions relative to their respective support bars 106, 108. Many other locking mechanisms have been contemplated using resistance, locking pins, pawl and ratchet systems, friction rings, and so forth.

Figure 7:
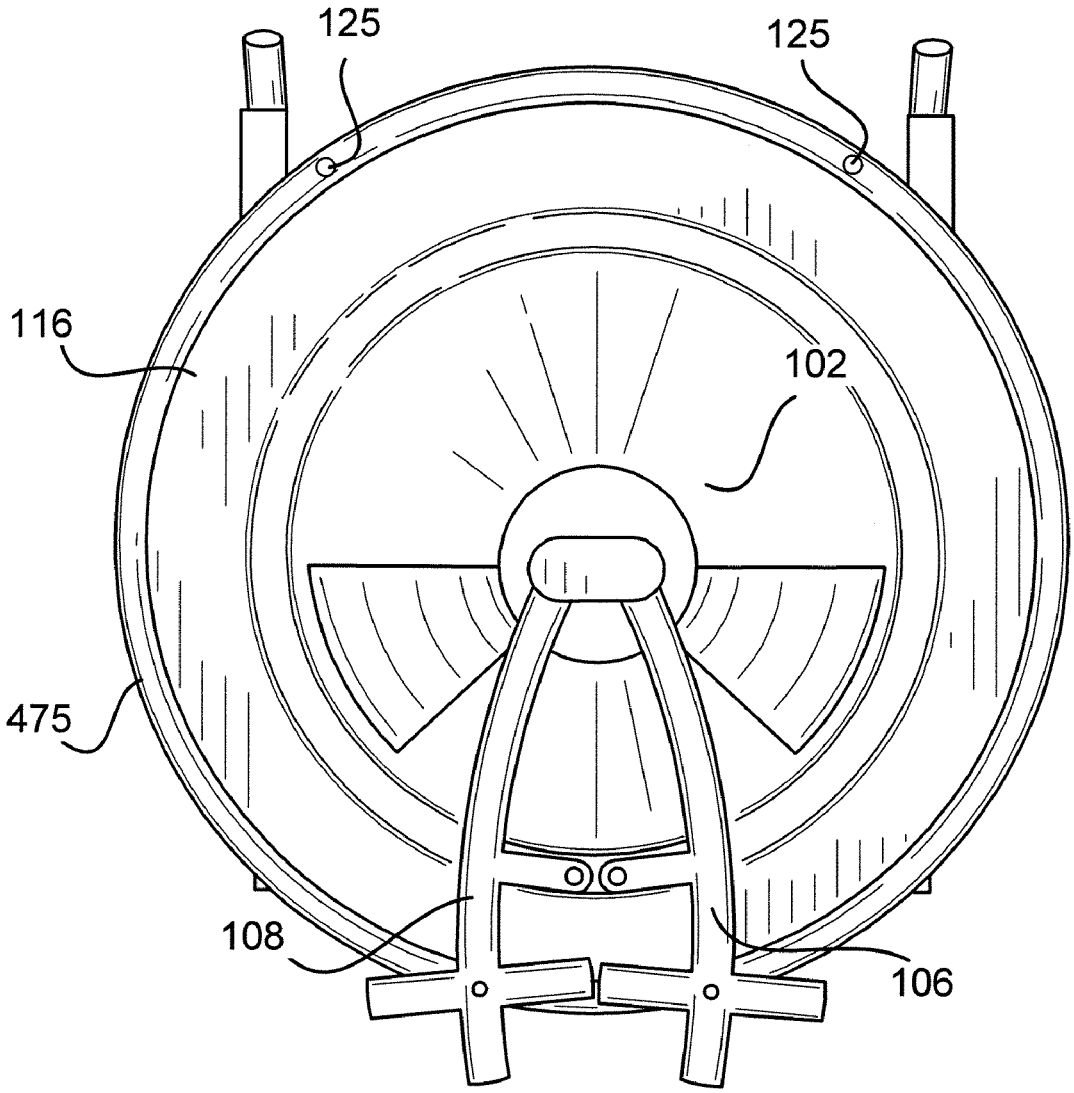
FIG. 7 is a perspective view of another exemplary embodiment.

FIG. 7 is a top view of another embodiment with the knee pads 110, 112 removed. As mentioned earlier, the support or contact ring 475 (hereafter referred to as contact ring) is disposed about the perimeter 116 of the base 102 and can be exposed, enabling the movement mechanism (shown as a roller) 406 to directly contact the contact ring 475. The direct contact nature shown in FIGS. 7-9 can operate to reduce stress on the perimeter 116 of the base 102, while providing the user the necessary support, being borne by the contact ring 475 rather than the perimeter 116 of the base 102. Additionally, the material or surface of the contact ring 475 can be made to be "quieter" than the material used in the base 102, or of a low rolling or surface friction, thus allowing less expensive materials to be used for the base 102. Consequently, the user may find it easier to slide/glide/roll around the perimeter contact ring 475. The nature of the contact ring 475 may be that is can be constructed from metal, plastic, fiberglass, and so forth, and is attached to base frame 104 and/or base 102. In an exemplary embodiment, the contact ring 475 can be constructed from tubular steel or tubular aluminum. Of course, as mentioned above, any material may be used that provides the functionality described above.

Figure 8:
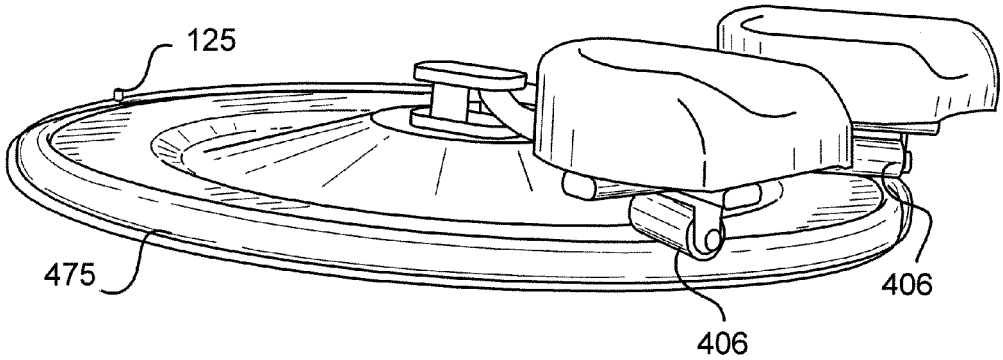
FIGS. 8 and 9 are perspective views of another exemplary embodiment.
Figure 9:
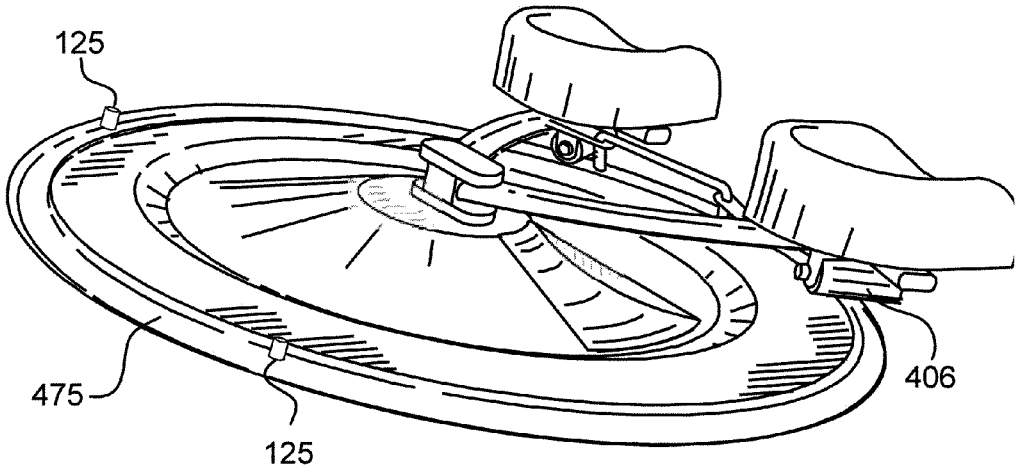

FIGS. 8 and 9 are perspective views showing direct contact of the movement mechanism 406 on the contact ring 475. It should be appreciated that while the term "ring" is used to describe the contact ring 475, any shape or cross-section for such a "ring" may be utilized without departing from the spirit and scope of this disclosure. For example, the contact ring 475 could be a flat-topped surface, or a series of mini-rollers, or have a contact surface that is angled with respect to the movement mechanism 406. In some embodiments, the movement mechanism 406 may be a low friction puck and operate by "gliding" over the top of a low-friction surface on the contact ring 475.

Also, it should be appreciated that the contact ring 475 may, in some instances, be disposed interior to the perimeter 116 of the base 102, as according to design preference. Additionally, the contact ring 475 may also terminate near restriction members 125.

In some embodiments, the handle 114 allows the user to support his upper body while performing an exercise. In some embodiments, the handle 114 may be adjustable to change the positioning, the angle, or the length of the handle 114. This provides a wide variety of positions for the user to select the most comfortable position, to select a position providing an appropriate intensity of exercise or to select a position providing the desired type of exercise. The handle 114 may be pivotably attached to the front portion 300 of the base frame 104, similar to that of the front and rear supports, such that the handle 114 is pivotable in an upward, downward, and rearward direction so as to change the angle created between the handle 114 and the base frame 104 as shown in FIG. 4. The sleeve 122 extending from the front base frame 104 may accommodate the handle 114, or the handle 114 may be attached to the base frame 104 at a pivot point 403. The base frame 104 may have holes 401 into which a locking member 400 may be inserted so as to immobilize the sleeve 122 and/or handle 114 relative to the base frame 104 as shown in FIG. 4.

In some embodiments, the handle 114 may be extendable or telescopic by mounting the handle 114 in a sleeve 122 with a plurality of apertures 408, wherein the handle 114 further comprising a locking pin 400. The handles 114 also comprise a plurality of apertures 410 to correspond with the apertures 408 of the sleeve 122 to increase the length of the handle 114. Telescoping handles allow the exercise device to accommodate users of different sizes as well as different exercises for the same user. In some embodiments, the exercise device comprises a single handle 114 that can support both arms. In other embodiments, the exercise device 100 may have two separate handles 114, one handle 114 for each arm with a gap between the handles 114.

In some embodiments, the exercise device 100 may further comprise a crossbar 510 removably attached to the first and second support bars 106, 108 to temporarily immobilize the first and the second support bars 106, 108 relative to each other. Thus, a user may secure the crossbar 510 across the support bars 106, 108 to conduct exercises with his legs stabilized in the same position relative to each other so that the legs may move in harmony. It is noted that contact points of the crossbar 510 to the support bars 106, 108 may "rotate," allowing the support bars 106, 108 to move in near synchrony. Alternatively, the user may remove the crossbar 510 connection to allow his knees to either move in opposite directions or to move in an alternating manner.

In some embodiments, each leg support 106, 108 may have a tab 504, 506 with a hole 508, wherein the hole 508 is configured to receive the crossbar 510. Each tab 504, 506 may extend approximately perpendicularly from the leg supports 106, 108 towards each other when the leg supports 106, 108 are in a neutral or resting position. The tabs 504, 506 may have a plurality of holes 508 so that the distance between the first knee pad 110 and the second knee pad 112 may be adjusted with a crossbar 510 having a fixed length.

In another embodiment, the leg supports 106, 108 may have the holes 508 configured to receive the crossbar 510. In some embodiments, each leg support may have a plurality of holes 508 along the length of the leg support 106, 108, from the support ends 210, 212 to the mounting ends 206, 208 to allow for the adjustability of the distance between the knee pads 110, 112. Due to the triangular configuration formed by the leg supports 106, 108 and the crossbar 510 (with the mounting ends 206, 208 forming the apex and the crossbar 510 forming the base of the triangle), moving the crossbar 510 closer to the center 200 of the base 102 or towards the mounting ends 206, 208, increases the distance between the knee pads 110, 112 relative to each other.

In another embodiment, a telescoping crossbar may be used to increase or decrease the distance between the knee pads 110, 112.

In some embodiments, the intensity of the exercises may be further increased by attaching resistance mechanisms (not shown) to support bars 106, 108. The resistance mechanisms may be weights, elastomer members, spring members, viscous members, pneumatic members, or any other means to increase the force required to move the knee pads 110, 112 along the base 102.

Numerous different types of exercises for the lower and upper body are contemplated to target a variety of different muscle groups. A non-exclusive list of exercises that may be performed with this exercise device as described below.

In use, a user may adjust the incline of the exercise device 100, by adjusting the height of the front portion 300, the rear portion 302, or both. The user may also adjust the length, height, and angle of the handles 114 so that the user can maintain a comfortable position. The crossbar 510 may be inserted into the holes 508 to lock or immobilize the knee pads 110, 112 relative to each other. The user may then place his knees on the knee pads 110, 112 and grasp the handles 114 to stabilize his upper body. Using the abdominal and lower back muscles, the user may swing the knees towards his left side and right side in an alternating fashion forcing the knee pads 110, 112 to move along the appropriate path along the perimeter 116 of the base 102 to perform one type of exercise. Thus, by utilizing the various pivoting mechanisms described as well as having adjustable supports 304, 306 and adjustable handle positions 114, the described embodiments enable the user to adjust the orientation of the user's motion within several planes, that is, up, sideways, and forward, rather than being constricted to a single plane of motion. Accordingly, the user can customize his or her exercise, increasing or decreasing the level of effort and scope of motion, as needed, for a more focused exercise regimen.

In another type of exercise, the crossbar 510 may be removed. Utilizing various muscle groups of the hips and thighs, as well as the abdomen, sides, and back, the user may then swing both knees to the left and right causing a lateral flexion of the legs relative to the spine. In another type of exercise, the user may alternately abduct the left leg to the left and abduct the right leg to the right and return the legs to the neutral position to work the muscles of the hip and inner and outer thigh muscles. In another type of exercise, the user can move the left leg while simultaneously moving the right leg, then bring both legs back towards the center or the neutral position, thereby exercising the hips and thighs.

Though it has been discovered by the inventor that this exercise device is well-suited for abdominal training or waist reduction, the versatility of this exercise device also allows the user to exercise his upper body. For example, the user may exercise his chest and triceps by performing modified push-ups with his hands on the handle 114 and his knees on the knee pads 110, 112. In embodiments with two handles 114, the intensity of the push-up may be increased by dipping the chest below the level of the handles into the gap between the handles 114. The versatility of this exercise device also allows for exercising the latissimus dorsi, biceps, and forearms by performing a modified pull-up or a modified lat pull-down. With the crossbar 510 removed the user places his knees on the knee pads 110, 112, grasps the handle 114 and pulls himself partially upwards or forwards by contracting his biceps and latissimus dorsi. The lower body and knee pads 110, 112 follow by crunching or flexing the abdominal muscles and flexing the hip muscles to bring the knees towards the chest laterally through the arcuate path along the perimeter 116 of the base 102. The user can also exercise the triceps and shoulders by elevating the rear portion 302 above the front portion 300 and pushing himself away from the handles 114 while the knees slide backward toward the rear portion 302 of the base 102. The intensity of any of these exercises can be changed simply by changing the incline of the base 102 or by adding resistance mechanisms. Accordingly, while the user may configure the exercise device to primarily target his or her abdominal areas, the exemplary exercise device is configurable to provide a core body workout, that is, the upper body including the back can also be rigorously exercised for cardio, strength as well as for weight loss objectives. Also, with the exercise device, an enhanced movement of the person's truncal muscles and spinal joints is achieved. Since the exercise device is used with the user "kneeling" on the device, there will be minimal gravity-induced axial loading of the user's spine.

The foregoing description of the embodiments described herein has been presented for the purposes of illustration and description. It is not intended to be exhaustive or to limit the scope of the described embodiments to the precise form disclosed. Many modifications and variations are possible in light of the above teaching. It is intended that the scope of the disclosure not be limited by this detailed description, but by the claims and the equivalents to the claims appended hereto.

This exercise device may be industrially applied to the development, manufacture, and use of an exercise device. The device may comprise a base, a frame, a handle and a pair of knee pads that can move about the base. The knee pads may be attached to support bars, which in turn are pivotably anchored near the center of the base to allow movement in an elliptical path. The exercise device can be used for a variety of exercises targeted towards the upper and lower body. The intensity of the exercises may be modified by changing the incline of the base or by adding resistance mechanisms.

What is claimed is:

1. An exercise device, comprising:

a base having a front end, a rear end, a center, and a perimeter;

an exposed contact ring disposed about the perimeter of the base;

first and second independently pivotal knee supports, coupled to substantially vertical first and second pivot points located off from the center of the base;

independently rotatable first and second knee pads coupled to a perimeter-side end of the first and second knee supports, respectively, wherein the first and second knee pad are supported by the contact ring;

an upper extremity support coupled to the front end of the base; and a first base supporting member being positioned at the rear end of the base and a second base supporting member being positioned at the front end of the base, wherein the first and second knee supports move along different arcs around the contact ring.

2. The exercise device of claim 1, wherein the base supporting members are pivotally attached to the base, permitting the base supporting members to be folded, wherein an overall size of the exercise device is reduced when the base supporting members are folded.

3. The exercise device of claim 1, wherein the upper extremity support is pivotally attached to the base.

4. The exercise device of claim 3, wherein the upper extremity support has an adjustable length.

5. The exercise device of claim 1, wherein the base supporting members and the upper extremity support member are coupled to the base via a frame attached to the base.

6. The exercise device of claim 1, further comprising a low moving friction surface at a bottom of the knee supports, in contact with the contact ring.

7. The exercise device of claim 6, wherein the low moving friction surfaces are rollers.

8. The exercise device of claim 1, wherein the first and second knee support arms are coupled to each other.

9. The exercise device of claim 1, wherein at least one of the knee pads is lockable to prevent rotation of the knee pad.

10. An exercise device, comprising:

a main supporting means for supporting an individual in a kneeling position;

first and second supporting means for controlling motion of knees of the individual, coupled to first and second pivots located off from a center of the main supporting means;

cushioning means for cushioning knees of the individual, coupled to the first and second supporting means, the cushioning means being independently rotatable;

a third supporting means for supporting an upper extremity of the individual, coupled to the main supporting means; and a fourth supporting means for supporting the main supporting means, wherein at least one of an inclination and elevation of the main supporting means is determined by adjustment of a length of the fourth supporting means, wherein the first and second supporting means move along different arcs around at least one of a perimeter of the main supporting means and the contact means to generate an elliptical motion for the individual.

11. The exercise device of claim 10, wherein the fourth supporting means are pivotally attached to the mains supporting means, permitting the fourth supporting means to be folded, wherein an overall size of the exercise device is reduced when the fourth supporting means are folded.

12. The exercise device of claim 10, wherein the third supporting means is pivotally attached to the main supporting means.

13. The exercise device of claim 10, wherein a length of the third supporting means is adjustable.

14. The exercise device of claim 10, wherein the third and fourth supporting means are coupled to the main supporting means via a frame.

15. The exercise device of claim 10, further comprising low friction means for providing a low friction contact between the first and second supporting means with the contact means.

16. The exercise device of claim 15, wherein the low friction means are movable.

17. The exercise device of claim 10, wherein the first and second supporting means are coupled to each other.

18. A method for operating an exercise machine, comprising:

adjusting a height of supporting legs for the exercise machine, wherein at least one of an inclination and elevation of the exercise machine is determined by the adjustment;

placing knees on independently rotatable knee pads attached to first and second supports configured to control a motion of the knees, the first and second supports being coupled via first and second pivot points located off center from a center of a base;

placing hands on an upper extremity support coupled to the base; and moving the knee pads along different arcs around at least one of a perimeter of the base and a contact ring.

19. The method of claim 18, wherein the upper extremity support is adjustable in at least one of a pivot angle and length.

20. The method of claim 18, wherein the knee pads are coupled together.

21. An exercise device, comprising:

a base having a front end, a rear end, a center, and a perimeter;

an exposed contact ring disposed about the perimeter of the base;

first and second independently pivotal knee supports, coupled to the center of the base;

independently rotatable first and second knee pads coupled to a perimeter-side end of the first and second knee supports, respectively, wherein the first and second knee pads are supported by the contact ring;

an upper extremity support coupled to the front end of the base; and a first base supporting member being positioned at the rear end of the base and a second base supporting member being positioned at the front end of the base, wherein the first and second knee supports move about the contact ring.

* * * * *